US010096954B2

(12) United States Patent
Demura et al.

(10) Patent No.: US 10,096,954 B2
(45) Date of Patent: Oct. 9, 2018

(54) CONNECTOR

(71) Applicant: Japan Aviation Electronics Industry, Limited, Tokyo (JP)

(72) Inventors: Yuko Demura, Tokyo (JP); Takeshi Ebisawa, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/815,064

(22) Filed: Nov. 16, 2017

(65) Prior Publication Data

US 2018/0219338 A1 Aug. 2, 2018

(30) Foreign Application Priority Data

Jan. 27, 2017 (JP) ..... 2017-013310

(51) Int. Cl.

| | |
|---|---|
| ***H01R 9/05*** | (2006.01) |
| ***H01R 12/00*** | (2006.01) |
| ***H01R 24/40*** | (2011.01) |
| ***H01R 13/405*** | (2006.01) |
| ***H01R 13/6473*** | (2011.01) |
| ***H01R 12/71*** | (2011.01) |

(Continued)

(52) U.S. Cl.

CPC ..... *H01R 24/40* (2013.01); *H01R 9/09* (2013.01); *H01R 12/714* (2013.01); *H01R 12/727* (2013.01); *H01R 13/405* (2013.01); *H01R 13/6473* (2013.01); *H01R 13/6596* (2013.01); *H01R 24/64* (2013.01); *H01R 2103/00* (2013.01)

(58) Field of Classification Search

CPC ..... H01R 24/50; H01R 24/52; H01R 24/44; H01R 12/727; H01R 13/6585; H01R 24/545; H01R 9/0521; H01R 9/05; H01R 9/0524

See application file for complete search history.

(56) References Cited

U.S. PATENT DOCUMENTS 6,468,089 B1 * 10/2002 Hubbard ..... H01R 24/50 439/63
7,086,867 B2 * 8/2006 Nakagawa ..... H01R 24/42 439/63

(Continued)

FOREIGN PATENT DOCUMENTS

JP H08-203619 A 9/1996

*Primary Examiner* — Xuong Chung Trans

(74) *Attorney, Agent, or Firm* — Muncy, Geissler, Olds & Lowe, P.C.

(57) ABSTRACT

A connector includes a contact, an insulator that holds the contact, and a conductive shell that surrounds and holds the insulator, the contact having a contact portion that is disposed in a counter-connector accommodation portion of the conductive shell, a board connection portion that is to be inserted in a through-hole in a board and connected to a signal pattern of the board, a fixing portion that is disposed between the contact portion and the board connection portion and is fixed to the insulator, a bending portion that is disposed between the fixing portion and the board connection portion and is elastically deformable so as to bend with respect to a fitting direction, and a movable hold portion that is disposed between the bending portion and the board connection portion and is held by the insulator so as to be movable within a predetermined range.

8 Claims, 7 Drawing Sheets

(51) Int. Cl.

| | |
|---|---|
| ***H01R 12/72*** | (2011.01) |
| ***H01R 24/64*** | (2011.01) |
| ***H01R 13/6596*** | (2011.01) |
| *H01R 103/00* | (2006.01) |

(56) References Cited

U.S. PATENT DOCUMENTS

| | | | | |
|---|---|---|---|---|
| 9,124,047 | B2 * | 9/2015 | Kanda | H01R 13/6474 |
| 2005/0112918 | A1 * | 5/2005 | Su | H01R 24/50<br>439/79 |

* cited by examiner

FIG. 13
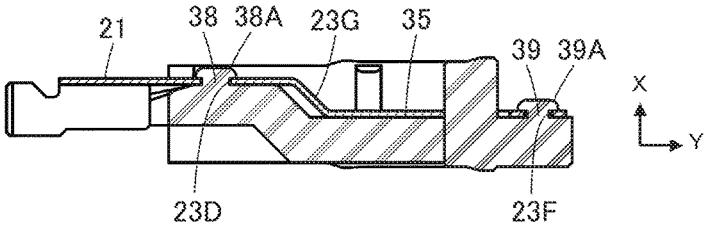
FIG. 14
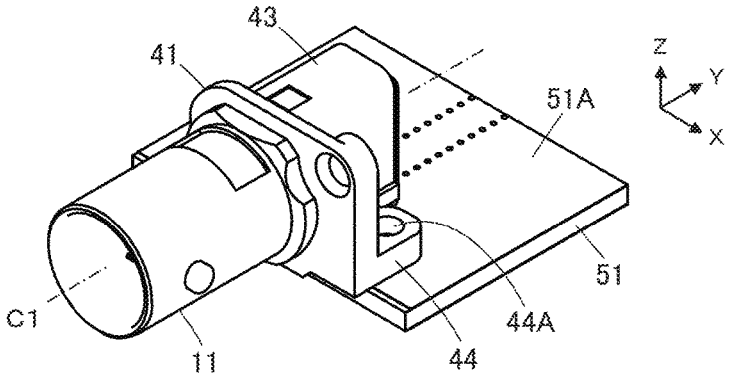
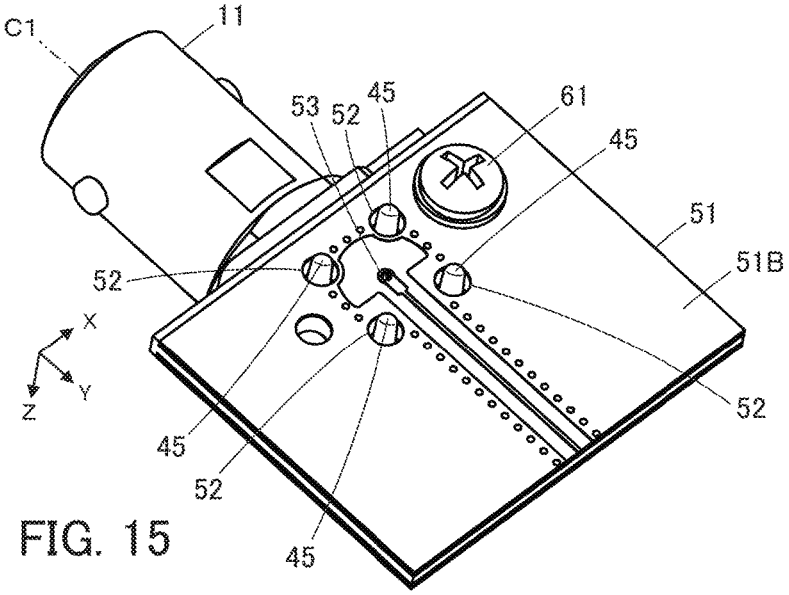
FIG. 15

CONNECTOR

BACKGROUND OF THE INVENTION

The present invention relates to a connector, in particular, to a connector that is mounted on a board and fitted with a counter connector along a fitting direction.

As a connector to be mounted on a board, for example, JP H08-203619 A discloses a connector 1 as illustrated in FIG. 19. The connector 1 includes a shell portion 2 with which a counter connector is fitted; with a pair of attachment portions 3 connected to the shell portion 2 being in contact with a surface of a board (not shown), the connector 1 is mounted on the board by tightening screws in fixing holes 4 in the attachment portions 3. A contact 5 drawn from the inside of the shell portion 2 to the back of the shell portion 2 is electrically connected to a signal pattern of the board.

However, when the connector 1 is fixed to the board by tightening screws by in the fixing holes 4 in the attachment portions 3, torque around each of the fixing holes 4 acts on the connector 1 as the screws are rotated, whereby the contact 5 drawn to the back of the shell portion 2 may be misaligned with the signal pattern of the board. If the contact 5 is misaligned with the signal pattern of the board, electrical connection therebetween would hardly be established.

In addition, in the case where an end portion of the contact 5 is inserted into a through-hole formed in the board and is connected to the signal pattern of the board through soldering, the connector 1 is fixed to the board by the screws with the end portion of the contact 5 being inserted in the through-hole. Accordingly, if the connector 1 receives torque as the screws are rotated, the end portion of the contact 5 would be pressed against an inner surface of the through-hole of the board, whereby the end portion of the contact 5 may be damaged.

When the connector 1 is fixed to the board by tightening two screws in the pair of fixing holes 4 as illustrated in FIG. 19, even if the contact 5 is misaligned during the screwing of the first screw, such positional misalignment of the contact 5 can be corrected during the screwing of the second screw. However, the end portion of the contact 5 having been inserted in the through-hole of the board may be damaged during the screwing of the first screw.

SUMMARY OF THE INVENTION

The present invention has been made in order to solve the conventional problem described above and is aimed at providing a connector capable of having a board connection portion of a contact surely connected to a signal pattern of a board without damage, even when the connector is attached to the board with the board connection portion of the contact being inserted in a through-hole of the board.

A connector according to the present invention comprises:

a contact;

an insulator that holds the contact; and a conductive shell that includes a counter-connector accommodation portion and that surrounds and holds the insulator, wherein the contact includes a contact portion that is formed at one end of the contact and is disposed in the counter-connector accommodation portion of the conductive shell, a board connection portion that is formed at the other end of the contact and is to be inserted in a through-hole in a board and connected to a signal pattern of the board, a fixing portion that is disposed between the contact portion and the board connection portion and is fixed to the insulator, a bending portion that is disposed between the fixing portion and the board connection portion and is elastically deformable so as to bend with respect to a fitting direction, and a movable hold portion that is disposed between the bending portion and the board connection portion and is held by the insulator so as to be movable within a predetermined range.

BRIEF DESCRIPTION OF THE DRAWINGS

FIG. 13 is a cross-sectional view taken along line B-B in FIG. 12.

FIG. 14 is a perspective view of the connector according to the embodiment mounted on a board when viewed from obliquely above.

FIG. 15 is a perspective view of the connector according to the embodiment mounted on the board when viewed from obliquely below.

DETAILED DESCRIPTION OF THE INVENTION

An embodiment of the present invention is described below based on the appended drawings.

Figure 1:
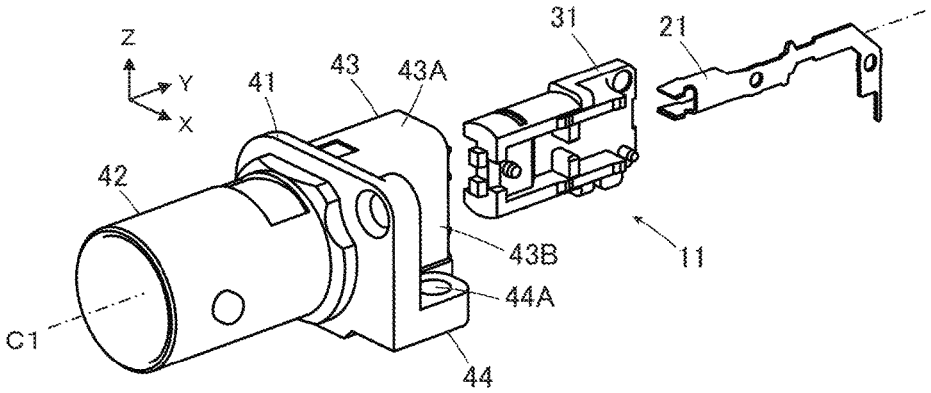
FIG. 1 is an exploded perspective view of a connector according to an embodiment of the present invention.

FIG. 1 is an exploded view of a connector 11 according to the embodiment. The connector 11 is to be fitted with a counter connector (not shown) in a fitting direction along a fitting axis C1 and includes a contact 21, an insulator 31 for holding the contact 21, and a conductive shell 41 that surrounds and holds the insulator 31.

The conductive shell 41 is formed of a conductive material such as metal, and includes a counter-connector accommodation portion 42 in a cylindrical shape around the fitting axis C1 and a shell body 43 adjacently connected to the counter-connector accommodation portion 42 along the fitting axis C1. The shell body 43 has a substantially U-shaped cross section composed of a top plate portion 43A extending in parallel with the fitting axis C1 and a pair of side plate portions 43B separately extending perpendicularly to the top plate portion 43A from the opposite ends, in a direction orthogonal to the fitting axis C1, of the top plate portion 43A such that the pair of side plate portions 43B face each other across the fitting axis C1. The inside of the shell body 43 communicates with the inside of the counter-connector accommodation portion 42.

The conductive shell 41 further includes a board attachment portion 44 connected to the opposite end of the shell body 43 from the top plate 43A and overhanging to a lateral of the shell body 43, and the board attachment portion 44 is provided with a single attachment hole 44A comprising a screw hole.

For convenience, a direction from the counter-connector accommodation portion 42 toward the shell body 43 of the conductive shell 41 along the fitting axis C1 is referred to as "+Y direction," a direction from the top plate portion 43A of the shell body 43 of the conductive shell 41 toward the other end of the shell body 43 at which the board attachment portion 44 is provided as "−Z direction," and a direction in which the board attachment portion 44 overhangs from the shell body 43 of the conductive shell 41 as "+X direction."

The contact 21, which is held by the insulator 31, is disposed inside the counter-connector accommodation portion 42 and the shell body 43 of the conductive shell 41.

Figure 2:
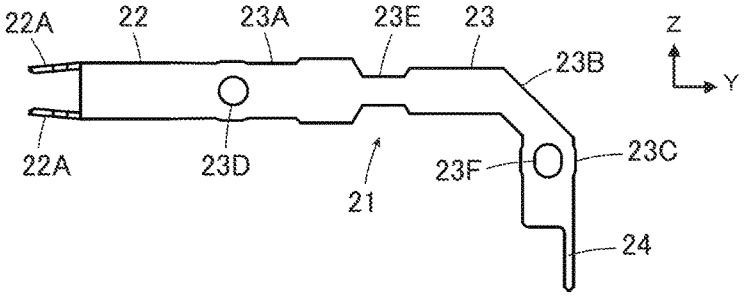
FIG. 2 is a side view of a contact used in the connector according to the embodiment.
Figure 3:
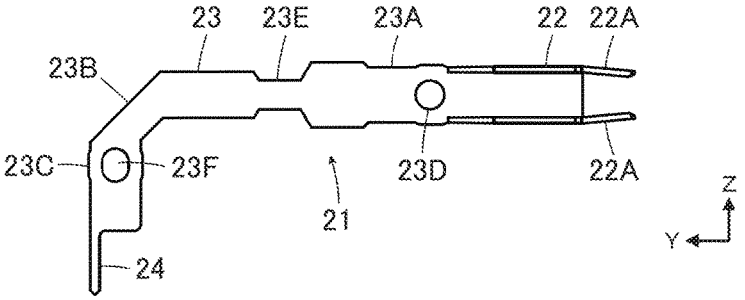
FIG. 3 is a side view of the contact used in the connector according to the embodiment when viewed from the side opposite from FIG. 2.

As illustrated in FIGS. 2 and 3, the contact 21 is made of a metal sheet and includes a contact portion 22 that comes into contact with a contact of a counter connector (not shown), a hold portion 23 that is connected to the contact portion 22 and is to be held by the insulator 31 and a board connection portion 24 that is connected to the hold portion 23.

The contact portion 22 extends in the Y direction along the fitting axis C1 and has a pair of contact points 22A arranged along the Z direction in a facing manner so as to sandwich the contact of the counter connector (not shown) in the Z direction when the counter connector is fitted with the connector 11.

The hold portion 23 has an extension portion 23A that is connected to the +Y directional end of the contact portion 22 and extends in the Y direction along the fitting axis C1, an inclined portion 23B that is connected to the +Y directional end of the extension portion 23A and obliquely extends in the +Y direction and the −Z direction from the +Y directional end of the extension portion 23A, i.e., extends in an inclined direction with respect to the fitting axis C1, and a perpendicular portion 23C that extends in the −Z direction perpendicularly to the fitting axis C1 from the +Y and −Z directional end of the inclined portion 23B.

The extension portion 23A is provided with a fixing portion 23D located near the contact portion 22 and comprising a circular through-hole and a narrowed portion 23E located nearer to the inclined portion 23B than to the fixing portion 23D and locally narrowing in the Z direction.

In addition, the perpendicular portion 23C is provided with a movable hold portion 23F having an oval hole elongated in the Z direction that is perpendicular to the fitting direction.

The perpendicular portion 23C may be directly connected to the extension portion 23A without the inclined portion 23B intervening therebetween. However, particularly in order for high-frequency electric signals to smoothly flow, it is preferable to dispose the inclined portion 23B extending in a direction inclined to both of the Y and Z directions between the extension portion 23A and the perpendicular portion 23C as connecting them.

Figure 4:
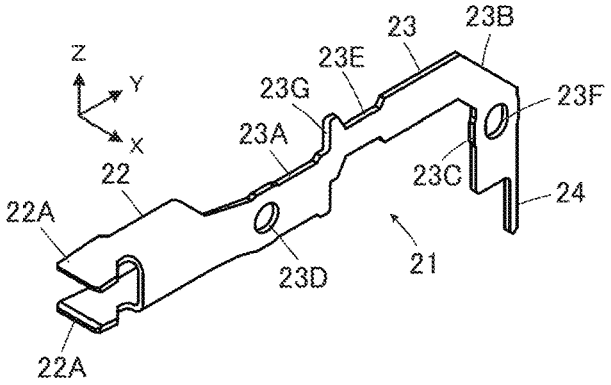
FIG. 4 is a perspective view of the contact used in the connector according to the embodiment.
Figure 5:
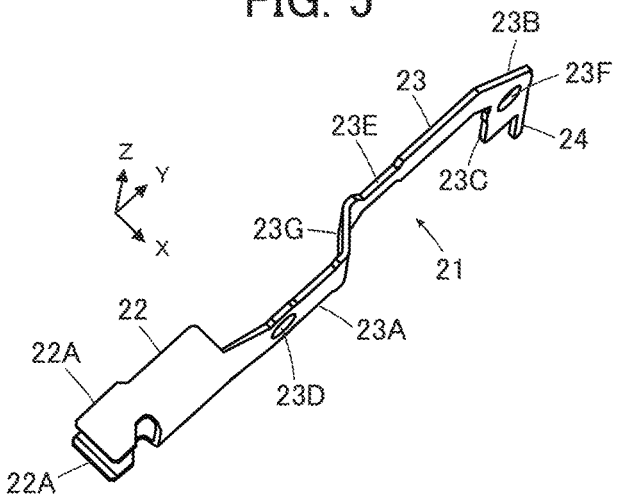
FIG. 5 is a perspective view of the contact used in the connector according to the embodiment when viewed at a different angle from FIG. 4.

As illustrated in FIGS. 4 and 5, an elastically deformable bending portion 23G bending in the X direction is formed between the fixing portion 23D and the narrowed portion 23E in the extension portion 23A of the contact 21. The extension portion 23A extends in the +Y direction from the +Y directional end of the contact portion 22, bends at the bending portion 23G to deviate in the −X direction, and then extends again in the +Y direction to reach the inclined portion 23B. In the extension portion 23A, a part located on the −Y direction side and a part located on the +Y direction side with respect to the bending portion 23G are each formed in a flat plate shape and extend along the YZ plane in parallel with each other while being arranged to be apart from each other in the X direction. The bending portion 23G is formed in a flat plate shape that continuously connects the parts of the extension portion 23A individually located on the −Y direction side and on the +Y direction side with respect to the bending portion 23G and is inclined in a direction intersecting the Y direction, i.e., the fitting direction.

Owing to the presence of the above-described bending portion 23G, the pair of contact points 22A of the contact portion 22 come into contact with a contact of a counter connector positioned on the fitting axis C1, while the +Y directional end of the extension portion 23A between the bending portion 23G and the inclined portion 23B can be positioned on the fitting axis C1.

Since the bending portion 23G is located between the fixing portion 23D and the board connection portion 24, the bending portion 23G warps when the board connection portion 24 receives an external force in the YZ plane; accordingly, the contact 21 is configured such that the board connection portion 24 can move relatively to the fixing portion 23D within the YZ plane.

The board connection portion 24 has a pin shape and is inserted in a through-hole of a board (not shown) and soldered to a signal pattern of the board when the connector 11 is mounted on the board. The board connection portion 24 is formed to project in the −Z direction from the −Z directional end of the perpendicular portion 23C and is located in the YZ plane passing through the fitting axis C1.

Figure 6:
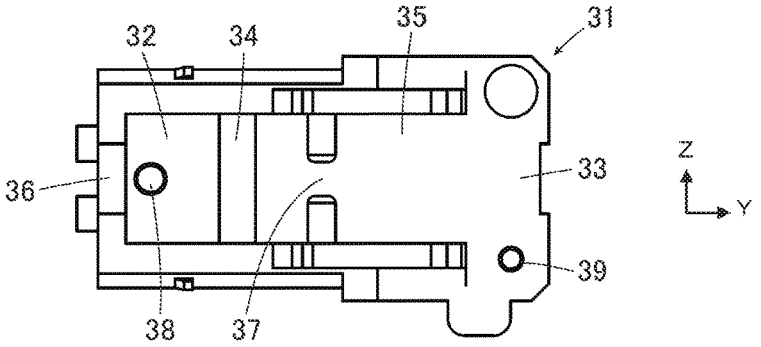
FIG. 6 is a side view of an insulator used in the connector according to the embodiment.
Figure 7:
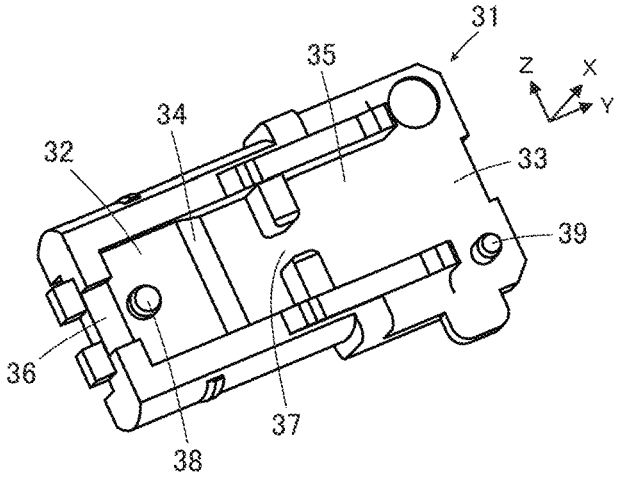
FIG. 7 is a perspective view of the insulator used in the connector according to the embodiment.

The insulator 31 is made of an insulating material such as an insulating resin and, as illustrated in FIGS. 6 and 7, includes flat surfaces 32 and 33 extending along the YZ plane and facing the +X direction and an inclined surface 34 disposed between the flat surfaces 32 and 33 and facing the +X and +Y directions. The flat surfaces 32 and 33 and the inclined surface 34 together form a contact holding surface 35 with which the −X directional surface of the hold portion 23 of the contact 21 comes into contact.

In addition, at the −Y directional end of the flat surface 32 and on the flat surface 33, contact position limiting portions 36 and 37 for limiting movement of the contact 21 in the Z direction are each formed between a pair of projections facing each other across a gap in the Z direction and projecting in the +X direction.

The flat surfaces 32 and 33 are respectively provided with cylindrical bosses 38 and 39 projecting in the +X direction.

Figure 8:
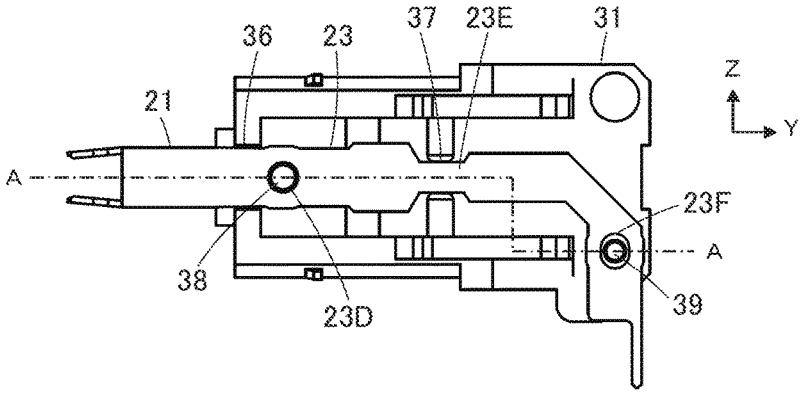
FIG. 8 is a side view of the insulator with which the contact is aligned.
Figure 9:
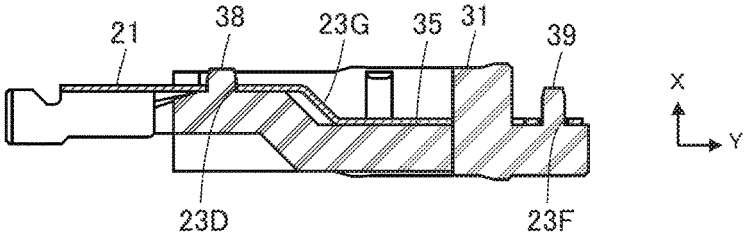
FIG. 9 is a cross-sectional view taken along line A-A in FIG. 8.

As illustrated in FIGS. 8 and 9, the contact 21 is aligned with the insulator 31 such that the boss 38 formed on and projecting from the flat surface 32 of the insulator 31 is inserted in the circular through-hole constituting the fixing portion 23D of the contact 21 while the boss 39 formed on and projecting from the flat surface 33 of the insulator 31 is inserted in the oval hole constituting the movable hold portion 23F of the contact 21, and the −Y directional end portion and the narrowed portion 23E of the hold portion 23 of the contact 21 are respectively fitted in the contact position limiting portions 36 and 37 of the insulator 31, whereby the contact 21 is held on the contact holding surface 35 of the insulator 31.

Note that the Z directional gaps at the contact position limiting portion 36 and at the contact position limiting portion 37 of the insulator 31 are respectively set to values larger than the Z directional widths of the −Y directional end portion and of the narrowed portion 23E of the hold portion 23 of the contact 21 only by a component tolerance and an assembly tolerance of the contact 21 and the insulator 31; the −Y directional end portion and the narrowed portion 23E of the hold portion 23 of the contact 21 are positionally limited in the Z direction by the contact position limiting portions 36 and 37 of the insulator 31, respectively.

In addition, the circular through-hole constituting the fixing portion 23D of the contact 21 has a diameter slightly larger than a diameter of the boss 38 of the insulator 31. In particular, the diameter of the fixing portion 23D is set to a value slightly larger than the diameter of the boss 38 by the component tolerance and assembly tolerance of the contact 21 and the insulator 31.

Figure 10:
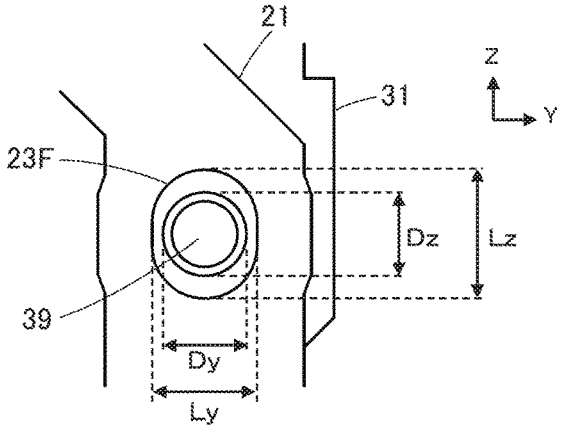
FIG. 10 is a side view of an oval hole of the contact to which a boss of the insulator is inserted.

Further, the oval hole constituting the movable hold portion 23F of the contact 21 has a Y directional length Ly slightly longer than a Y directional length Dy of the boss 39 of the insulator 31 and a Z directional length Lz longer than a Z directional length Dz (i.e., Dy) of the boss 39 by a predetermined length, as illustrated in FIG. 10. In particular, the Y directional length Ly of the movable hold portion 23F is set to a value larger than the Y directional length Dy of the boss 39 such that the component and assembly tolerances of the contact 21 and the insulator 31 are included in the Y directional length Ly of the movable hold portion 23F while a space in which the movable hold portion 23F can move relatively to the boss 39 is formed. Meanwhile, the Z directional length Lz of the movable hold portion 23F is set to a value larger than the Z directional length Dz of the boss 39 by a predetermined length which exceeds the component and assembly tolerances of the contact 21 and the insulator 31.

By setting the Z directional widths of the −Y directional end portion and of the narrowed portion 23E of the hold portion 23 of the contact 21, the Z directional gaps at the contact position limiting portion 36 and at the contact position limiting portion 37 of the insulator 31, the sizes of the fixing portion 23D and the movable hold portion 23F of the contact 21 and the sizes of the bosses 38 and 39 as described above, it is possible to have the contact 21 readily held on the contact holding surface 35 of the insulator 31 even if the respective portions of the contact 21 and the insulator 31 vary in size within the component tolerance and the assembly tolerance.

Figure 11:
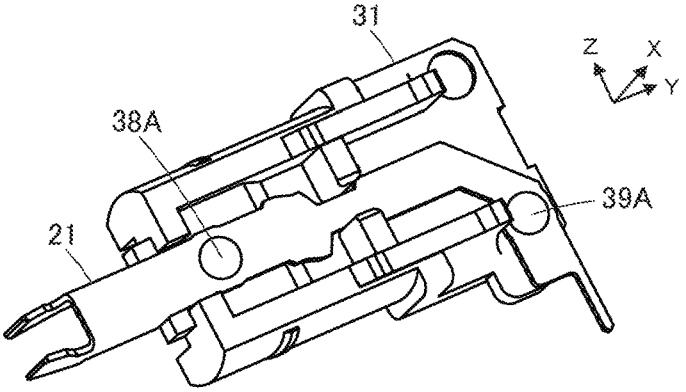
FIG. 11 is a perspective view of the insulator to which the contact is attached.
Figure 12:
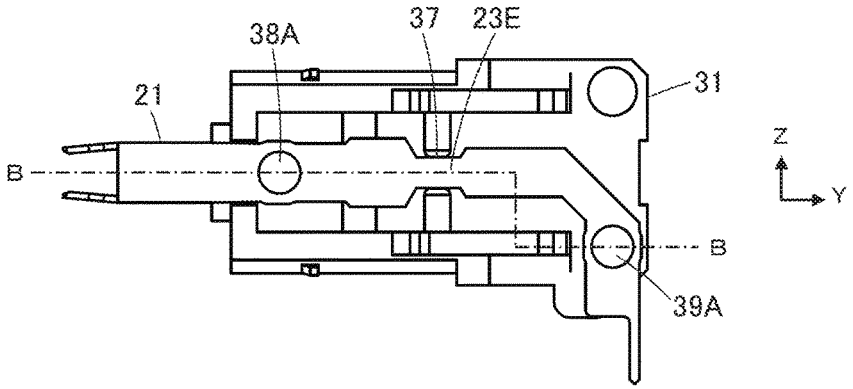
FIG. 12 is a side view of the insulator to which the contact is attached.

When the contact 21 is held on the contact holding surface 35 of the insulator 31 in this manner, as illustrated in FIG. 9, the bosses 38 and 39 of the insulator 31 penetrate through the fixing portion 23D and the movable hold portion 23F of the contact 21, respectively, and head parts of the bosses 38 and 39 protrude in the +X direction. Subsequently, the head parts of the bosses 38 and 39 protruding in the +X direction are heated and thermally deformed, thereby forming, on the +X direction side of the contact 21, thermally-deformed portions 38A and 39A that are larger than the fixing portion 23D and the movable hold portion 23F of the contact 21, as illustrated in FIGS. 11 to 13.

At this time, the boss 38 penetrating through the fixing portion 23D of the contact 21 is welded to the contact 21 through formation of the thermally-deformed portion 38A contacting with the +X directional surface of the contact 21 so as to allow no space to be formed between the boss 38 and the contact 21. Accordingly, the fixing portion 23D of the contact 21 is fixed to the insulator 31 in a relatively immovable manner with respect to the insulator 31.

At the boss 39 penetrating through the movable hold portion 23F of the contact 21, on the other hand, the thermally-deformed portion 39A is formed such that a small gap remains between the thermally-deformed portion 39 and the +X directional surface of the contact 21. Accordingly, the movable hold portion 23F of the contact 21 is held in a relatively movable manner with respect to the insulator 31. More specifically, since the movable hold portion 23F has the Z directional length Lz longer than the Z directional length Dz of the boss 39 by a predetermined length, the movable hold portion 23F is allowed to relatively move in the Z direction only for the predetermined length but is limited in relative movement in the X direction with respect to the insulator 31.

When the insulator 31 by which the contact 21 is held is inserted and pressed into the shell body 43 and the counter-connector accommodation portion 42 from the +Y directional end of the conductive shell 41, the insulator 31 is held inside the conductive shell 41, whereby the connector 11 is assembled.

The connector 11 is used as being mounted on a board 51 as illustrated in FIGS. 14 and 15.

While a front surface 51A of the board 51 is used as a mounting surface, the connector 11 is placed such that the shell body 43 and the board attachment portion 44 of the conductive shell 41 are in contact with the front surface 51A of the board 51, and a fixing screw 61 is passed through and screwed into the attachment hole 44A formed in the board attachment portion 44 of the conductive shell 41 from a back surface 51B of the board 51, whereby the connector 11 is fixed to the board 51 in such a way that the fitting axis C1 extends in parallel with the front surface 51A of the board 51. In the meantime, the attachment hole 44A of the connector 11 is placed at a position away from the YZ plane passing through the fitting axis C1 toward the +X direction.

As illustrated in FIG. 15, the conductive shell 41 includes four shell leg portions 45 formed at and projecting from the −Z directional end of the shell body 43 in the −Z direction, and with the shell leg portions 45 being separately inserted in four shell leg portion fixing through-holes 52 formed in the board 51, the connector 11 is fixed to the board 51.

Figure 16:
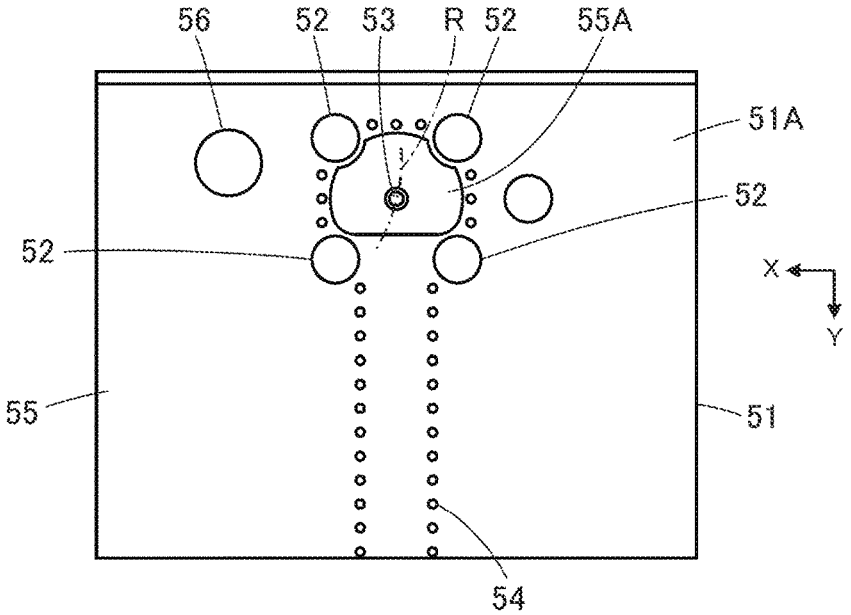
FIG. 16 is a view of a front surface of the board.

FIG. 16 illustrates the front surface 51A of the board 51. The board 51 is provided with a contact connecting through-hole 53 penetrating through the board 51. The contact connecting through-hole 53 has a diameter that allows the pin-shaped board connection portion 24 of the contact 21 of the connector 11 to be inserted. The four shell leg portion fixing through-holes 52 are arranged around the contact connecting through-hole 53 so as to surround a periphery of the contact connecting through-hole 53.

The board 51 is also provided with a plurality of ground pattern connecting through-holes 54 penetrating through the board 51.

The contact connecting through-hole 53, the four shell leg portion fixing through-holes 52 and the plurality of ground pattern connecting through-holes 54 all have conductive plating on their entire inner surfaces.

In addition, a first ground pattern 55 is formed over the almost entire front surface 51A of the board 51 except the vicinity of the contact connecting through-hole 53, and the four shell leg portion fixing through-holes 52 and the plurality of ground pattern connecting through-holes 54 are electrically connected to the first ground pattern 55. In the front surface 51A of the board 51, an end of the contact connecting through-hole 53 is located inside an opening 55A formed in the first contact pattern 55 and is separated from the first ground pattern 55 with a gap therebetween.

Moreover, the board 51 includes, at a position deviated toward almost the +X direction from the contact connecting through-hole 53, a thorough-hole 56 through which the fixing screw 61 is passed to fix the connector 11 to the board 51.

Figure 17:
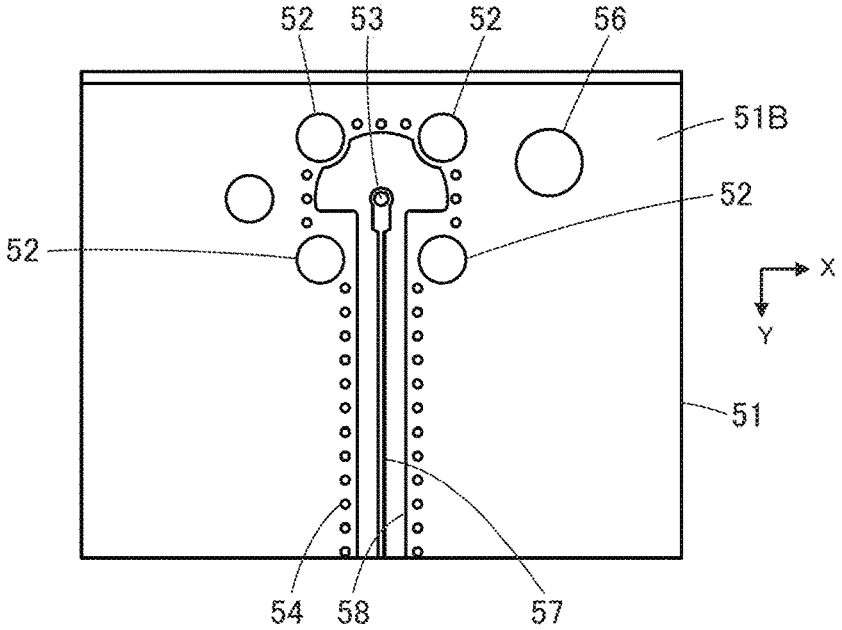
FIG. 17 is a view of a rear surface of the board.

As illustrated in FIG. 17, a signal pattern 57 is disposed on the back surface 51B of the board 51 so as to be connected to the contact connecting through-hole 53, while a second ground pattern 58 is disposed so as to surround a periphery of the signal pattern 57. The second ground pattern 58 is separated and electrically insulated from the signal pattern 57.

On the back surface 51B of the board 51, the four shell leg portion fixing through-holes 52 and the plurality of ground pattern connecting through-holes 54 are electrically connected to the second ground pattern 58. The second ground pattern 58 on the back surface 51B of the board 51 is electrically connected to the first ground pattern 55 on the front surface 51A of the board 51 via the ground pattern connecting through-holes 54.

When the connector 11 is mounted on the board 51, first, the connector 11 is disposed on the board 51 such that, with the four shell leg portions 45 of the conductive shell 41 and the board connection portion 24 of the contact 21 of the connector 11 being respectively inserted in the four shell leg portion fixing through-holes 52 and the contact connecting through-hole 53 in the board 51, the shell body 43 and the board attachment portion 44 of the conductive shell 41 come into contact with the front surface 51A of the board 51.

In this state, the fixing screw 61 is inserted in the through-hole 56 of the board 51 from the back surface 51B of the board 51, as illustrated in FIG. 15, and is screwed into the attachment hole 44A formed in the board attachment portion 44 of the conductive shell 41, whereby the connector 11 is fixed to the board 51.

At this time, as the fixing screw 61 is screwed into the attachment hole 44A, torque around the attachment hole 44A acts on the connector 11. In the meantime, the board connection portion 24 of the contact 21 of the connector 11 inserted in the contact connecting through-hole 53 of the board 51 is positioned on the YZ plane passing through the fitting axis C1, whereas the fixing screw 61 inserted in the through-hole 56 of the board 51 and screwed into the attachment hole 44A of the connector 11 is in a position away from the YZ plane passing through the fitting axis C1 toward the +X direction. Accordingly, the board connection portion 24 of the contact 21 of the connector 11 inserted in the contact connecting through-hole 53 of the board 51 receives a force for moving along an arc R whose center is the through-hole 56, as illustrated in FIG. 16.

As a result, the board connection portion 24 of the contact 21 is pressed substantially in the Y direction against the inner surface of the contact connecting through-hole 53 of the board 51 to receive a force therefrom. Meanwhile, the movable hold portion 23F of the contact 21 is held by the insulator 31 so as to be relatively movable with respect to the insulator 31 for the predetermined length in the Z direction, and the elastically deformable bending portion 23G is disposed between the fixing portion 23D and the board connection portion 24 in the contact 21. Consequently, the bending portion 23G warps, and a part of the contact 21 extending in the +Y direction from the narrowed portion 23E that is positionally limited in the Z direction by the contact position limiting portion 37 of the insulator 31 slopes with respect to the fitting axis C1, whereby the force applied from the inner surface of the contact connecting through-hole 53 of the board 51 to the board connection portion 24 of the contact 21 is prevented from concentrating on the board connection portion 24. Accordingly, the connector 11 can be fixed to the board 51 without damage, e.g., bending and breaking off, of the board connection portion 24.

Figure 18:
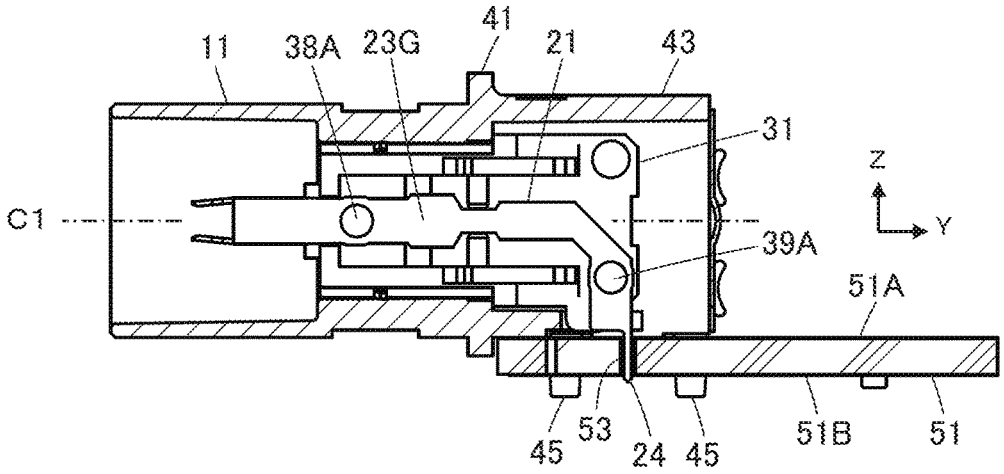
FIG. 18 is a cross-sectional view of the connector according to the embodiment mounted on the board.
Figure 19:
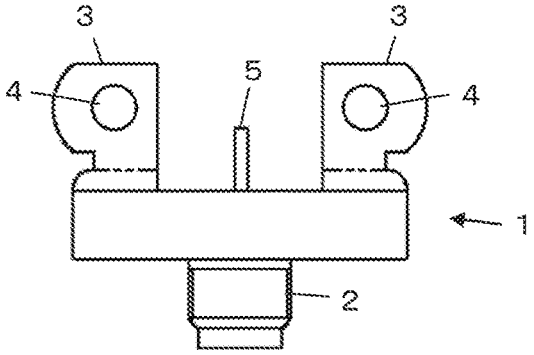
FIG. 19 PRIOR ART
FIG. 19 is a perspective view of a conventional connector mounted on a board.

After the connector 11 is fixed to the board 51 with the fixing screw 61 as described above, the shell leg portions 45 of the conductive shell 41 and the board connection portion 24 of the contact 21 of the connector 11 are respectively soldered to the shell leg portion fixing through-holes 52 and the contact connecting through-hole 53 of the board 51 from the back surface 51B of the board 51. Accordingly, the connector 11 is mounted on the board 51 as illustrated in FIG. 18, and the board connection portion 24 of the contact 21 of the connector 11 is electrically connected to the signal pattern 57 of the board 51 while the shell leg portions 45 of the conductive shell 41 of the connector 11 are electrically connected to the first ground pattern 55 and the second ground pattern 58 of the board 51.

When the contact connecting through-hole 53 of the board 51 is designed to have a large inside diameter, even if the board connection portion 24 of the contact 21 moves as the connector 11 is fixed to the board 51 with the fixing screw 61, a force applied from the inner surface of the contact connecting through-hole 53 to the board connection portion 24 of the contact 21 can be small. However, for high-speed transmission of electrical signals, the inside diameter of the contact connecting through-hole 53 is required to be so small as to suppress changes in impedance.

According to the present invention, even when the inside diameter of the contact connecting through-hole 53 is made small for high-speed transmission of electrical signals, a force applied from the inner surface of the contact connecting through-hole 53 to the board connection portion 24 of the contact 21 can be absorbed by the contact 21, and the connector 11 can be mounted on the board 51 without damage to the board connection portion 24 of the contact 21.

In the foregoing embodiment, the boss 39 of the insulator 31 that is inserted in the oval hole constituting the movable hold portion 23F of the contact 21 has a cylindrical shape, and the Y directional length Dy and the Z directional length Dz of the boss 39 are set to a same value; however, the present invention is not limited thereto. As long as the Y directional length Ly of the movable hold portion 23F is set to a value larger than the Y directional length Dy of the boss 39 such that the component and assembly tolerances of the contact 21 and the insulator 31 are included in the Y directional length Ly of the movable hold portion 23F and a space for moving with respect to the boss 39 is formed while the Z directional length Lz of the movable hold portion 23F is set to have a value larger than the Z directional length Dz of the boss 39 by a predetermined length which exceeds the component and assembly tolerances of the contact 21 and the insulator 31, the Y directional length Dy and the Z directional length Dz of the boss 39 may be different from each other. Even in this case, the movable hold portion 23F of the contact 21 can relatively move in the Z direction with respect to the insulator 31 for a predetermined length.

In addition, in the foregoing embodiment, the head parts of the bosses 38 and 39 of the insulator 31 are heated and thermally deformed, thereby forming the thermally-deformed portions 38A and 39A; however, the present invention is not limited thereto. A fixing part may be provided at the insulator 31 to fix the fixing portion 23D of the contact 21, and a spring part or the like may be provided at the insulator 31 to movably hold the movable hold portion 23F of the contact 21, for example.

In the foregoing embodiment, as illustrated in FIGS. 4 and 5, the bending portion 23G of the contact 21 obtusely bends in the X direction with respect to the Y direction that is the fitting direction; however, the present invention is not limited thereto. The bending portion 23G may orthogonally bend from the Y direction to the X direction. In addition, the bending portion 23G may be formed to be narrow with a small width in the Z direction for easy elastic deformation.

What is claimed is:

1. A connector that is mounted on a board and that is fitted with a counter connector along a fitting direction, the connector comprising:

a contact;

an insulator that holds the contact; and a conductive shell that includes a counter-connector accommodation portion and that surrounds and holds the insulator, wherein the contact includes a contact portion that is formed at one end of the contact and is disposed in the counter-connector accommodation portion of the conductive shell, a board connection portion that is formed at the other end of the contact and is to be inserted in a through-hole in the board and connected to a signal pattern of the board, a fixing portion that is disposed between the contact portion and the board connection portion and is fixed to the insulator, a bending portion that is disposed between the fixing portion and the board connection portion and is elastically deformable so as to bend with respect to the fitting direction, and a movable hold portion that is disposed between the bending portion and the board connection portion and is held by the insulator so as to be movable within a predetermined range.

2. The connector according to claim 1, wherein the movable hold portion is held by the insulator such that the movable hold portion can move along a plane including the fitting direction and a direction perpendicular to a mounting surface of the board and is limited in movement in a direction perpendicular to the plane.

3. The connector according to claim 1, wherein the conductive shell includes at least one attachment hole that is disposed at a position separated away from the board connection portion of the contact when viewed from the fitting direction and that is used for screwing to the board.

4. The connector according to claim 3, wherein the conductive shell includes only the one attachment hole.

5. The connector according to claim 1, wherein the fitting direction is parallel to a mounting surface of the board, wherein the contact includes an extension portion extending in the fitting direction, and a perpendicular portion connected to the extension portion and extending in a direction perpendicular to the fitting direction, wherein the contact portion, the fixing portion and the bending portion are disposed in the extension portion, wherein the movable hold portion and the board connection portion are disposed in the perpendicular portion, wherein the bending portion bends in a direction parallel to the mounting surface of the board, and wherein the movable hold portion has an oval hole into which a boss is inserted and which is elongated in a direction perpendicular to the fitting direction, the boss being formed at the insulator and protruding therefrom.

6. The connector according to claim 5, wherein the contact includes an inclined portion connecting the extension portion to the perpendicular portion and extending in a direction inclined with respect to the fitting direction.

7. The connector according to claim 5, wherein the insulator includes a contact position limiting portion that limits movement of the contact in a direction perpendicular to the mounting surface of the board by coming in contact with a vicinity of the bending portion of the contact.

8. The connector according to claim 5, wherein the conductive shell includes a shell leg portion that extends in a direction perpendicular to the fitting direction and that is to be fixed to the board.

* * * * *